United States Patent [19]

Rubinstein et al.

[11] Patent Number: 4,564,069

[45] Date of Patent: Jan. 14, 1986

[54] IN-PLACE WELLBORE CONSOLIDATION IN PETROLEUM RESERVOIRS USING SULFUR-OIL POLYMERS

[75] Inventors: Ian Rubinstein; Raymond B. Woodford, both of Calgary, Canada

[73] Assignee: Exxon Production Research Co., Houston, Tex.

[21] Appl. No.: 600,272

[22] Filed: Apr. 13, 1984

[51] Int. Cl.[4] ..... E21B 33/138; E21B 43/02

[52] U.S. Cl. ..... 166/288; 166/292

[58] Field of Search ..... 166/288, 292, 276, 303

[56] References Cited

U.S. PATENT DOCUMENTS

| | | | |
|---|---|---|---|
| 3,332,490 | 7/1967 | Burtch et al. | 166/288 |
| 3,333,636 | 8/1967 | Groves, Jr. et al. | 166/288 |
| 3,373,812 | 3/1968 | Smith | 166/288 |
| 3,437,144 | 4/1969 | Fisher | 166/288 |
| 3,645,336 | 2/1972 | Young et al. | 166/288 |
| 3,690,377 | 9/1972 | Knight | 166/288 |
| 3,974,877 | 8/1976 | Redford | 166/276 |
| 4,232,740 | 11/1980 | Park | 166/276 |
| 4,391,555 | 7/1983 | Burger et al. | 166/288 X |

OTHER PUBLICATIONS

Terwilliger, et al., "Warm-Air Coking-A New Completion Method for Unconsolidated Sands", *Journal of Petroleum Technology,* Apr. 1964, pp. 367-371.

*Primary Examiner*—Stephen J. Novosad

*Attorney, Agent, or Firm*—E. Thomas Wheelock; Keith A. Bell

[57] ABSTRACT

A method for controlling sand production by consolidating an incompetent formation is disclosed. In this method, elemental liquid sulfur is suspended in steam which is injected into the formation. The sulfur reacts with the in-place hydrocarbon to form a consolidating agent.

18 Claims, 6 Drawing Figures

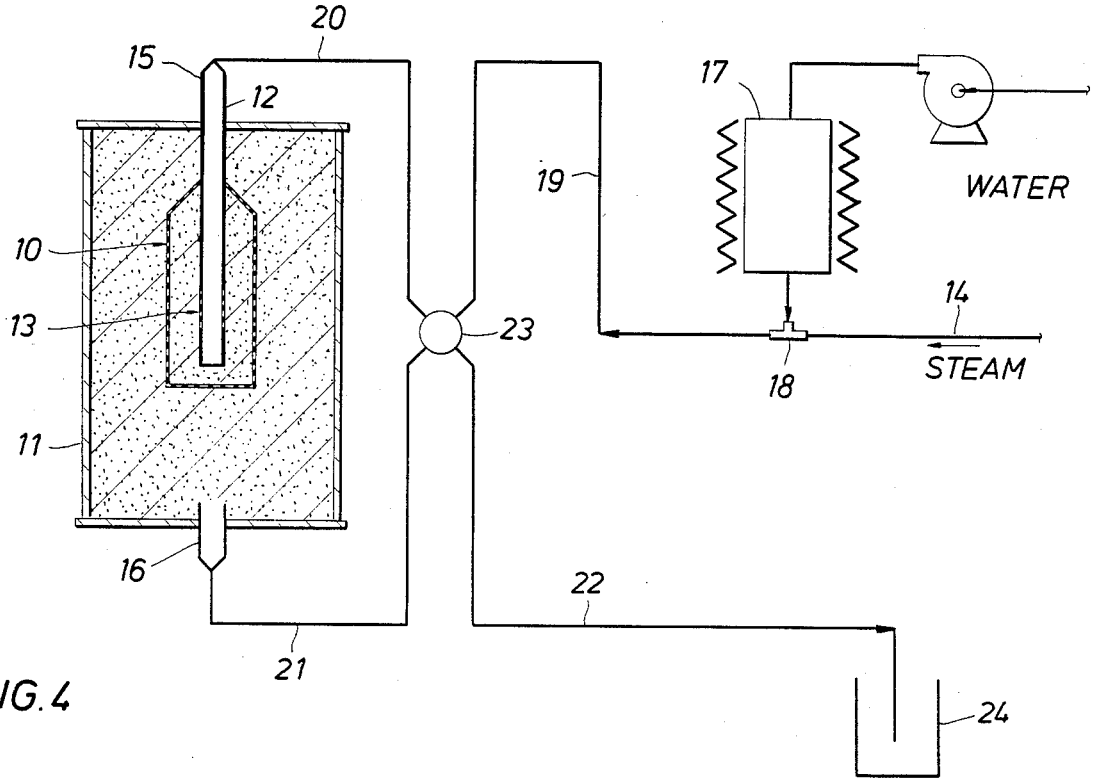
FIG. 4
FIG. 3
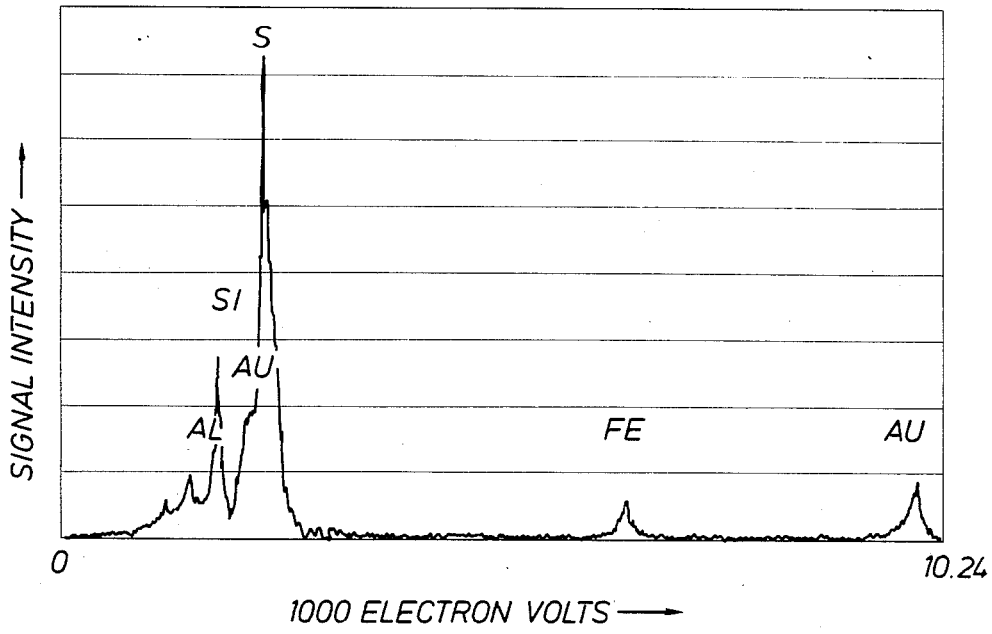

IN-PLACE WELLBORE CONSOLIDATION IN PETROLEUM RESERVOIRS USING SULFUR-OIL POLYMERS

FIELD OF THE INVENTION

This invention relates to a method for consolidating poorly or unconsolidated subterranean formations containing hydrocarbons. This invention more particularly relates to a method for consolidating unconsolidated subterranean formations which contain hydrocarbons by means of in-situ reactions to thereby stabilize the formation around said formation and control sand production from said formation.

BACKGROUND OF THE INVENTION

In many areas of the world, subterranean formations which contain large deposits of viscous petroleum are unconsolidated or partially consolidated in that the sand particles in the formation are wearkly bonded together. Such formations may be found in the Athabasca and Cold Lake regions in Alberta, And the Sisquoc region in California, U.S.A. These deposits are often referred to as "tar sand", "oil sand" or "heavy oil" due to the high viscosity of the hydrocarbons they contain. While some distinctions have arisen between tar sands and oil sands (viscosity between about 10,000 and 100,000 cP at reservoir temperature) and heavy oil (viscosity between about 1,000 and 10,000 cP at reservoir temperature), these terms will be used interchangeably herein. Tar sands often contain a viscous hydrocarbon material, commonly referred to as bitumen, in an amount which ranges from 5 to about 20% by weight. Bitumen is normally immobile at typical reservoir temperatures. However, at higher temperatures, such as temperatures of 90° C. or greater, the bitumen generally becomes mobile with a viscosity of less than 345 centipoise.

Since most tar sand deposits are too deep to be mined economically, various in-situ recovery processes have been proposed for separating the bitumen from the sand in the formation itself and producing the bitumen through a well drilled into the deposit. Among the various methods for in-situ recovery of bitumen from tar sands, processes which involve the injection of steam are generally regarded as most economical and efficient. Steam can be utilized to heat and fluidize the immobile bitumen and, in some cases to drive the mobilized bitumen towards production means.

The most common and proven method for recovering viscous hydrocarbon is by using steam stimulation techniques which involve heating a formation in the vicinity of a well to stimulate production back through the same well. In this type of process, steam is injected into a formation by means of a well and the well is shut-in to permit the steam to heat the bitumen, thereby reducing its viscosity. Subsequently, all formation fluids, including mobilized bitumen, water and steam, are produced from the same well using accumulated reservoir pressure as the driving force for production.

During production of formation fluids from such tar and oil-sands, the sand particles are removed from the formation and carried by the fluids to the borehole of the well. This produced sand at the borehole causes many problems. Produced sand may plug and erode the well, production tubing, pumps and other equipment and prevent petroleum production from the well. The sand also accumulates in stock tanks and catalyst beds causing expensive downtime for sand removal. If the sand is produced in fluids flowing at a high velocity, serious erosion, similar to erosion caused by sandblasting, may occur in tubular goods and other production equipment. Such high velocity fluid flows occur during steam and water enhanced oil recovery and in production from high pressure formations.

Various methods currently exist for controlling sand production from a subterranean formation. However, each method has its own disadvantages.

The method generally used for sand control employs the installation of slotted liners or screens in the tubular goods. Such liners or screens are designed to prevent the flow of sand into the well tubing by filtering such sand out of the produced formation fluids. The openings in the liners or screens are designed to prevent the flow of sand through them. However, such liners and screens often fail due to erosion and corrosion. They also may become plugged and prevent the flow of fluids from the formation. Erosion, corrosion and plugging make workover necessary to repair well equipment and allow further production.

Another sand control method requires placing a clean fine gravel pack around the wellbore. This makes a filter bed with small openings which prevents movement of produced sand into the wellbore. The filter bed also provides support for the unconsolidated formation. However, the particles in the gravel pack filter bed are not bound together and may move to plug well flow passages.

Several sand control methods involving consolidation of the sand formation surrounding the borehole have been suggested. Methods exist for consolidating sand formations by introducing cements, polymers, resins or ceramics outside the wellbore into the surrounding formation. U.S. Pat. No. 4,232,740 (Park) discloses a formation consolidation method which cements the formation sand particles together by injecting a series of aqueous solutions containing calcium hydroxide and a calcium salt with a solubility greater than that of calcium hydroxide. In the method of U.S. Pat. No. 4,391,555 (Burger et al) a formation is consolidated by injecting into the formation a liquid containing both a catalyst and a polymerizable chemical compound which hardens upon contact with an oxidizing gas. After injection of the liquid, an oxidizing gas is introduced into the formation, causing the polymer to solidify and consolidate the formation. The method of U.S. Pat. No. 3,332,490 (Burtch et al) places a devitrifiable glass in an unconsolidated formation, heats the formation to melt the glass, then applies further heat to devitrify the glass and consolidate the formation.

The sand control methods described above tend to stabilize the sand formations; however, they require placing potentially expensive materials outside the wellbore under tightly controlled conditions. Also, these forms of consolidation may reduce permeability, fail during high temperature recovery processes and require injection into a clean gravel pack to be effective.

More recently, methods for consolidating a formation for sand control using coking-type reactions have been employed. Terwillager, Smith and Goodwin in "Warm-Air-Coking—A New Completion Method for Unconsolidated Sands", *Journal of Petroleum Engineering*, April, 1964, pp. 367–371 discloses a "warm-air coking" method for consolidating sand formations which contain heavy crude. In this method, warm air is injected into an unconsolidated formation to oxidize the heavy crude. Oxidation is continued until an insoluble coke or resin forms to cement the sand particles and consolidate the formation. In U.S. Pat. No. 3,974,877 (Redford) sand control is provided by establishing a clean gravel pack around the wellbore, introducing bitumens into the gravel pack and injecting a mixture of steam and oxygen to form a permeable solid. However, processes which inject oxygen or air must be performed in ways which avoid spontaneous ignition in the formation. These limitations tend to render such methods expensive and unreliable. U.S. Pat. No. 3,333,636 (Groves et al) claims another coking method for formation consolidation. In Groves et al coke is formed in the sand surrounding the wellbore by injecting a sulfonating agent. The specific sulfonating agent used is sulfur trioxide. However, sulfur trioxide is difficult and expensive to handle. U.S. Pat. No. 3,437,144 (Fisher) claims a method for consolidating a formation by dissolving sulfur in oil and injecting the solution into the formation. The injected solution is then subjected to an elevated temperature, charring the oil to form a binder. However, this method requires the added expense of introducing oil into the wellbore. Also, the amount of sulfur which can be introduced into the wellbore is limited by the amount of sulfur which can be dissolved in the oil.

SUMMARY OF THE INVENTION

We have found that in-place hydrocarbons containing bitumens found in an incompetent subterranean formation will react with sulfur to form a consolidating agent which will stabilize the formation to provide sand control while preserving permeability which allows production of hydrocarbons and aqueous fluids from the formation. More specifically, we have discovered that droplets of liquid sulfur can be suspended in a carrier fluid such as steam, carried down the wellbore of an unconsolidated formation, introduced into such formation and reacted with in-place bitumens to form a consolidating agent for sand control.

BRIEF DESCRIPTION OF DRAWINGS

FIG. 3 is a spot x-ray spectra of the consolidating agent formed by the reaction of sulfur and oil sand petroleum.

FIG. 4 is a schematic diagram of the apparatus used to simulate three-dimensional wellbore consolidation by the method of the present invention.

DETAILED DESCRIPTION OF THE INVENTION

The present invention is a method for consolidating incompetent material in a subterranean hydrocarbon formation. In the method of this invention, liquid sulfur is suspended in a carrier fluid, introduced into the formation and reacted with bitumen-containing hydrocarbons in the formation to produce a consolidating agent. This consolidating agent stabilizes the formation around the wellbore and provides a means for limiting sand production in the wellbore. Yet, the consolidated area around the wellbore is permeable to formation fluids and allows production of hydrocarbons and aqueous fluids through the wellbore. In the preferred embodiment of the present invention, elemental sulfur is dispersed in steam. Steam carrying suspended sulfur is injected into the formation through the wellbore and the dispersed elemental sulfur is allowed to react with formation hydrocarbons to produce a consolidating agent around and between the sand particles of the formation. The reaction between the sulfur and the in-place hydrocarbons to form a consolidating agent is driven by heat supplied with the steam. The resulting consolidating agent stabilizes the formation around the wellbore and limits the sand produced from the formation. In the most preferred embodiment of the present invention, the formation has been heated prior to injection of steam carrying the suspended elemental sulfur.

The invention is illustrated by the examples which follow.

EXAMPLE I

Cold Lake Oil Sand samples containing unconsolidated sand and hydrocarbons were mixed with various concentrations of sulfur powder in a Hobart C-100 mixer. These sulfur and oil sand mixtures were packed into flow tubes. The flow tubes were placed in a laboratory steam flow apparatus.

Five oil sand samples containing 0%, 5%, 10%, 15% and 20% sulfur by weight were tested in the laboratory apparatus. An operating temperature of 290°±10° C., a heating time of 3 days and a steam flow of 2 mL per minute (as water) were the same for all five samples tested. For each sample, permeability before and after consolidation was determined. Also for each sample, compressive strength after consolidation was measured.

The compressive strength was measured by subjecting 5 cm lengths core to compressive force at a rate of 1 mm per minute. The results of these tests are summarized in the table below.

TABLE I

| Sample No. | Weight % Sulfur in Oil Sand | Permeability Before Consolidation (mD) | Permeability After Consolidation (mD) | Compressive Strength at Failure (KPa) |
|---|---|---|---|---|
| 1 | 0 | 650 | 111 | 512 |
| 2 | 5 | 500 | 590 | 6367 |
| 3 | 10 | 420 | 2490 | 5832 |
| 4 | 15 | 750 | 4820 | Not Determined |
| 5 | 20 | 1590 | 2200 | 625 |

Figure 1:
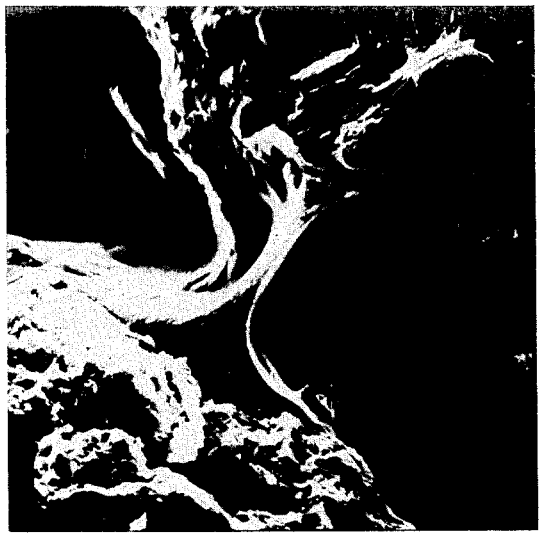
FIG. 1 is a photomicrograph of the sulfur induced petroleum consolidating agent between sand particles in a consolidated oil sand sample.
Figure 2:
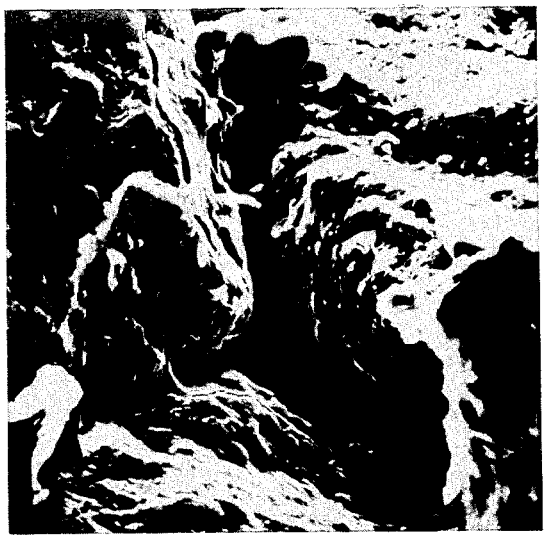
FIG. 2 is a photomicrograph of the sulfur induced petroleum consolidating agent around the sand particles in a consolidated oil sand sample.

FIGS. 1 and 2 contain two photomicrographs taken of pieces of the consolidated core from Sample No. 3 (10 weight % Sulfur). The photomicrographs were taken with the aid of a scanning electron microscope with spot x-ray analyses. These photomicrographs illustrate the microscopic effects of core consolidation with sulfur. The bitumen and sulfur reaction product which coats the sand particles then extends between the particles provides good mechanical stability in the core. However, as shown by the permeability measurements in Table I, pore spaces still exist in the now consolidated sand sample. This indicates that reservoir fluids can flow through the consolidated rock and into the wellbore for production.

FIG. 3 is a spot x-ray spectra of the consolidating agent developed by reaction of sulfur and oil sand bitumens in Sample No. 3. The spectra shows a high peak for sulfur. This indicates that sulfur has been incorporated into the bituminous hydrocarbon material surrounding the sand particles.

Two major conclusions may be drawn from this series of tests. First, the reaction of sulfur with oil sands produces a product which provides a consolidated core with good mechanical strength and adequate permeability. Second, the tests show that as long as the weight % of sulfur in the oil sand is about 5%, acceptable consolidation will occur. Apparently, any excess unreacted sulfur is carried away from the reaction by steam flow.

EXAMPLE II

A series of tests similar to those described in Example I were run to determine the effect of temperature on sulfur induced oil sand consolidation. The tests were run using five samples comprised of 10 weight % sulfur in Cold Lake Oil Sands. The results of these tests are summarized in the table below.

In the following tables, the term "effluent" refers to unreacted bitumen which was produced from the oil sand sample during steaming; the term "residue" refers to unreacted hydrocarbon remaining in the core and the term "coke" refers to the insoluble consolidating agent which is the reaction product of the sulfur and the in-place bitumen-containing hydrocarbon.

TABLE II

| Temperature °C. | % Yield on Bitumen Effluent | Residue | "Coke" | Compressive Strength at Failure (KPa) | Permeability After Consolidation (mD) |
|---|---|---|---|---|---|
| 150–steam | 20.4 | 6.5 | 50.4 | visually-good | not determined |
| 200–steam | 11.1 | 4.0 | 58.4 | 6432 | not determined |
| 275–steam | 8.9 | 16.9 | 59.2 | visually-good | 332 |
| 300–steam | 9.7 | 0.3 | 60.3 | visually-good | not determined |
| 200–nitrogen followed by steam | 8.1 | 4.4 | 59.4 | 7348 | not determined |

A mass balance of the bitumen attributed to effluent, residue and consolidating agent ("Coke") indicates a loss of bitumen from the oil sands sample. This is explained by the formation of $H_2S$ and the release of light hydrocarbons as gases. Also, in some tests the consolidated core adhered to the steel tube and had to be broken up with a chisel for removal from the tube. In these tests the compressive strength was not determined because an appropriately sized piece of core could not be found.

However, qualitative determinations of permeability and compressive strength indicate acceptable consolidation results. A review of the results listed in Table II indicates that in the 150° to 300° C. range tested, temperature has little effect on the amount of consolidating substance formed in the core, the compressive strength of the consolidated core or the permeability of the core.

EXAMPLE III

To simulate oil sand steam stimulation, a test was run to determine the stability of a sulfur consolidated core during a steam injection. A consolidated core was formed by mixing 10 weight % sulfur with Cold Lake Oil Sand, placing the mixture in a laboratory steam flow apparatus, then allowing steam to flow through the sample at 2 mL per minute for 3 days at 250° C. After consolidation, the coarse packing sand at each end of the core was removed. The core was heated to 350° C. and steam was injected at a rate of 8 mL per minute (as water) for 3 days. The inlet gas flow velocity was approximately 110 cm per minute at 150 psi and the outlet flow was 1100 cm per minute at atmospheric pressure. Visual inspection revealed no deconsolidation or sand particle movement. As reported below, the amount of consolidating agent ("Coke") formed, the compressive strength and the permeability are all adequate.

TABLE III

| % Yield on Bitumen Effluent | Residue | "Coke" | Compressive Strength at Failure (KPa) | Permeability After Consolidation (mD) |
|---|---|---|---|---|
| 30.5 | 0.3 | 48.9 | 960 | 900 |

EXAMPLE IV

Two tests were run to determine the feasibility of using steam to mobilize and carry sulfur to an unconsolidated core. 600 g Cold Lake Oil Sand were placed in the tube of a laboratory steam flow apparatus. Sulfur was mixed with the clean sand in the anterior portion of the tube. Steam was pumped through the apparatus for 3 days at a flow rate of 2 mL per minute (as water). The temperature of the reaction tube was 265° C. The results are summarized in the table below.

TABLE IV

| % Sw/w Oil Sand | % Yield on Bitumen Effluent | Residue | "Coke" | Compressive Strength at Failure (KPa) | Permeability After Consolidation (mD) |
|---|---|---|---|---|---|
| 10 | 25.4 | 0.9 | 49.2 | 4131 | 4000 |
| 19 | 23.5 | 0.8 | 45.9 | not determined | not determined |

Also, in the test with 10 weight % sulfur (60 g), 9.9 weight % (57 g) reacted with bitumen in the oil sand sample. In the 19 weight % (114 g) sulfur test, 17.6 weight % (105.6 g) reacted with the bitumen.

The results of these tests show that sulfur can be mobilized by steam to react with oil sand bitumen and form a consolidated region with acceptable permeability and compressive strength.

EXAMPLE V

A laboratory test was designed to closely simulate field conditions during steam stimulation and hot hydrocarbon production. Two aspects of field operation were of particular concern. First, the ability of a steam flow to carry sulfur some distance before the sulfur-containing steam is introduced into unconsolidated oil sands was tested. Second, the stability of a consolidated core during hot bitumen flow back was monitored.

FIG. 4 schematically illustrates the three dimensional wellbore simulation apparatus used. Referring to the figure, a mesh cage 10 packed with Cold Lake Oil Sand was placed inside a 24" by 12" o.d. pressure vessel 11. The mesh cage was used to facilitate easy removal upon completion of the experiment. A 6.35 mm long lab-scale wellbore 12, with 36 1.6 mm diameter perforations 13 over a 2.5 cm interval was placed in the oil sand sample. The entire apparatus was placed in a pressure vessel holding at 250 psi overpressure of nitrogen. Steam was passed from a steam generator 14 through steam lines 19 and 20 into the upper wellbore 15 at 300 psi and a flow rate of 50 mL per minute (as water). The oil sand temperature reached 190° C. and oil and water production from the lower wellbore 16 through lines 21 and 22 and into effluent collector 24 began after 3 hours of heating. After 8 hours, 250 g liquid sulfur from a 250° C. reservoir 17 was injected at a tee 18 in the steam line 19 at a rate of 8 mL per minute. Steaming continued for another 8 hours. More oil and water were produced and some hydrogen sulfide was evolved. Outlet line 20 and inlet line 21 were then reversed at reversing tap 23, causing steam injection through the lower wellbore 16 and production flow back through the consolidation. This was continued for 8 hours.

Figure 5:
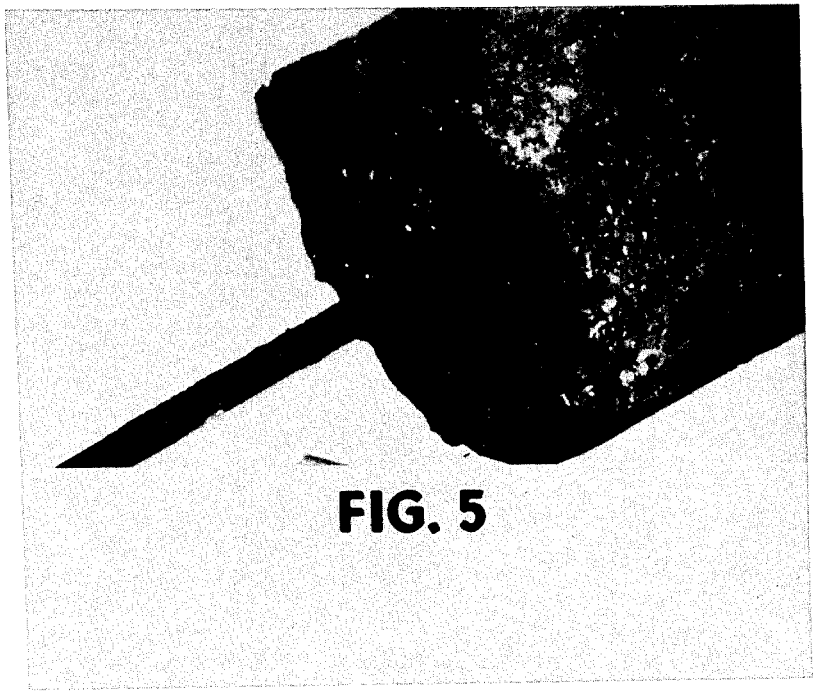
FIG. 5 is a photograph of an oil sand core consolidated in a three-dimensional simulation apparatus illustrated in FIG. 4.

A photograph of the consolidated core may be found at FIG. 5. Visual inspection of this core shows a stable, consolidated core. The consolidated sample maintained permeability as shown by continued steam flow. However, permeability in the consolidated core was lower than that of the unconsolidated core as indicated by a slight increase in steam pressure during production.

This test demonstrated that relatively rapid and acceptable consolidation may be effected at field conditions including the introduction of sulfur into the unconsolidated formation by way of the wellhead steam line. It was also shown that such sulfur induced consolidation can withstand steaming and hot bitumen fluid flowback.

EXAMPLE VI

Figure 6:
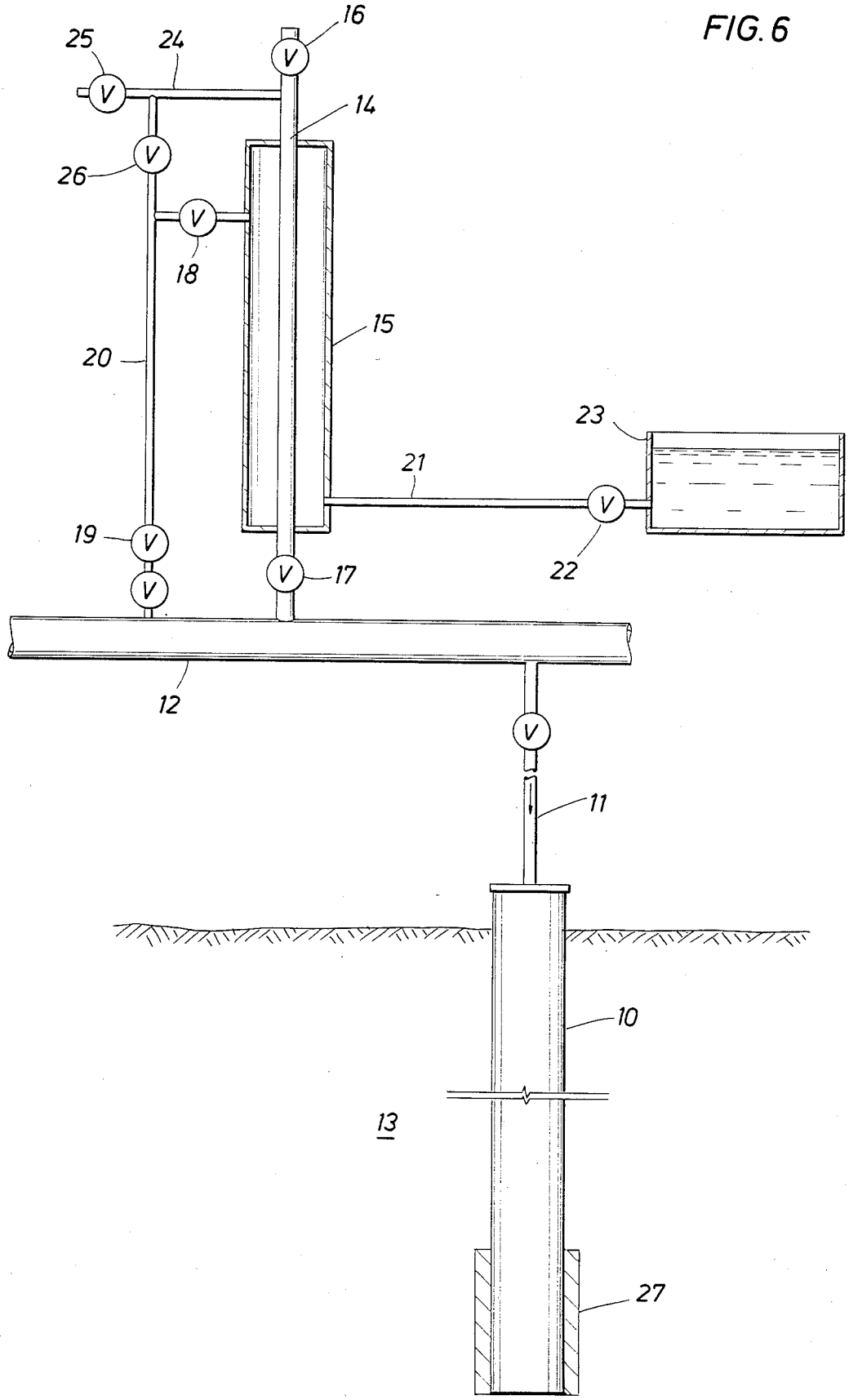
FIG. 6 schematically illustrates a field equipment configuration useful in practicing this invention in combination with a well penetrating an unconsolidated subterranean hydrocarbon formation.

A field test employing the consolidation process of the current invention has been performed. FIG. 6 schematically illustrates the equipment configuration used in the field test.

Prior to practicing the current invention, oil production from the test formation was achieved by conventional steam stimulation techniques. However, after producing 2 $m^3$ oil in 2 days, produced sand made continued operation of the well impossible. Production was suspended and the method of the current invention implemented as follows.

Referring to FIG. 6, steam at 9000 KPa and 235° C. was removed from the steam supply line 12 through the steam delivery line 11 and injected into the wellbore 10 and the unconsolidated formation 13. This steam stimulation continued for approximately 3½ days. Approximately 10 liters sulfur were added to sulfur vessel 14 through upper sulfur vessel valve 16. Valves 18 and 19 were opened to allow steam through steam line 20 and into steam jacket 15 surrounding sulfur vessel 14. Vessel 14 was heated for approximately 4 hours. Cooled steam and condensate were removed from the steam jacket 15 through line 21 and valve 22 into vent tank 23. Valve 17 was opened. Steam flowed through sulfur vessel 14 for approximately 3 hours. Vessel 14 was purged with nitrogen through line 24. An additional 4 liters of sulfur were introduced into the formation by the procedure described above. The consolidated formation was again produced by conventional steam stimulation. The well produced 40 $m^3$ oil during a 16 day interval. During this 16 day operation with a consolidated formation, sand production was not a problem.

Thus, the present invention provides a method for consolidating unconsolidated oil sands for control of sand production while maintaining adequate permeability for production of formation fluids. The present invention employs liquid sulfur which is carried into the formation by steam then reaets with the petroleum present in oil sands to produce a consolidating agent in-situ.

Various modifications and alterations in the practice of this invention will be apparent to those skilled in the art without departing from the scope and spirit of this invention. Although the invention was described in connection with a specific preferred embodiment, it should be understood that the invention as claimed should not be unduly limited to such specific embodiment.

What we claim is:

1. A method for reducing sand production from an unconsolidated subterranean hydrocarbon formation penetrated by a wellbore while leaving said formation permeable to the flow of formation fluids, said method comprising (a) heating said formation by injecting steam, (b) injecting steam carrying droplets of elemental liquid sulfur into said formation, (c) allowing said injected sulfur to react with hydrocarbon in said formation to produce a consolidating agent in said formation radially from said wellbore and thus (d) reducing sand production during hydrocarbon production from said formation.

2. The method of claim 1 wherein the mass ratio of sulfur introduced to hydrocarbon to be reacted is between 0.1 and 5.0.

3. The method of claim 1 wherein the time allowed for said sulfur and said hydrocarbon to react is 1 to 7 days.

4. The method of claim 1 wherein said consolidating agent is produced 10 to 50 cm beyond said wellbore.

5. The method of claim 1 wherein approximately one liter of said liquid sulfur is introduced into said formation for every perforation in said wellbore casing.

6. The method of claim 1 wherein during said reaction a reaction temperature of 100° to 350° C. is maintained.

7. The method of claim 6 wherein said reaction temperature is maintained by introduced steam, water, wet steam or combustion gas.

8. The method of claim 6 wherein said reaction temperature is maintained by the reacting sulfur and hydrocarbon.

9. The method of claim 1 wherein said hydrocarbon contains bitumen.

10. A method for reducing said production from an unconsolidated subterranean hydrocarbon formation penetrated by a wellbore while leaving said formation permeable to the flow of formation fluids, said method comprising (a) injecting steam carrying droplets of elemental liquid sulfur into said formation, (b) allowing said injected sulfur to react with hydrocarbon in said formation to produce a consolidating agent in said formation radially from said wellbore and thus (d) reducing said production during hydrocarbon production from said formation.

11. The method of claim 10 wherein the mass ratio of sulfur introduced to hydrocarbon to be reacted is between 0.1 to 5.0.

12. The method of claim 11 wherein the time allowed for said sulfur and said hydrocarbon to react is 1 to 7 days.

13. The method of claim 11 wherein said incompetent material is consolidated 10 to 50 cm beyond said wellbore.

14. The method of claim 11 wherein approximately one liter of said liquid sulfur is introduced into said formation for every perforation in said wellbore casing.

15. The method of claim 14 wherein said reaction temperature is maintained by the introduction of steam, water, wet steam or combustion gases.

16. The method of claim 14 wherein said reaction temperature is maintained by the reacting sulfur and hydrocarbon.

17. The method of claim 11 wherein during said reaction a reaction temperature of 100° to 350° C. is maintained.

18. The method of claim 11 wherein said hydrocarbon contains bitumen.

* * * * *